US012007158B2

(12) United States Patent
Cizik et al.

(10) Patent No.: US 12,007,158 B2
(45) Date of Patent: Jun. 11, 2024

(54) FOOD-RECEIVING CONTAINER HAVING A VENTILATION DEVICE ON A HANDLE OF A FRONT PANEL, AND HOUSEHOLD REFRIGERATION APPLIANCE

(71) Applicant: BSH Hausgeraete GmbH, Munich (DE)

(72) Inventors: Herbert Cizik, Ottenbach (DE); Max Eicher, Munich (DE); Ingo Heidenfelder, Taufkirchen (DE); Andreas Kessler, Munich (DE); Andreas Korte, Munich (DE); Philipp Kupfer, Nuremberg (DE); Carlos Ramos Alzamora, Munich (DE); Ralph Staud, Munich (DE); Thomas Tischer, Haar (DE)

(73) Assignee: BSH Hausgeraete GmbH, Munich (DE)

( * ) Notice: Subject to any disclaimer, the term of this patent is extended or adjusted under 35 U.S.C. 154(b) by 512 days.

(21) Appl. No.: 17/375,044

(22) Filed: Jul. 14, 2021

(65) Prior Publication Data

US 2022/0026138 A1 Jan. 27, 2022

(30) Foreign Application Priority Data

Jul. 23, 2020 (DE) ..... 102020209319.9

(51) Int. Cl.
*F25D 17/04* (2006.01)
*F25D 25/02* (2006.01)

(52) U.S. Cl.
CPC ..... *F25D 17/045* (2013.01); *F25D 25/025* (2013.01)

(58) Field of Classification Search
CPC .... F25D 17/045; F25D 17/042; F25D 25/025; F25D 2317/04131
See application file for complete search history.

(56) References Cited

U.S. PATENT DOCUMENTS

| | | | |
|---|---|---|---|
| 5,040,856 A | 8/1991 | Wilkins et al. | |
| 9,453,672 B2 | 9/2016 | Becke et al. | |

FOREIGN PATENT DOCUMENTS

| | | | | |
|---|---|---|---|---|
| CN | 104215011 A | * | 12/2014 | ..... F25D 17/04 |
| CN | 108870865 A | * | 11/2018 | ..... F25D 31/005 |
| EP | 2923165 A1 | | 9/2015 | |
| JP | 2009036436 A | * | 2/2009 | ..... F25C 5/22 |
| WO | WO-2012146581 A2 | * | 11/2012 | ..... F25D 25/025 |
| WO | 2013164341 A2 | | 11/2013 | |
| WO | 2014079739 A1 | | 5/2014 | |
| WO | 2014079781 A1 | | 5/2014 | |
| WO | 2014090644 A1 | | 6/2014 | |
| WO | WO-2015086185 A1 | * | 6/2015 | ..... F25D 25/025 |

* cited by examiner

*Primary Examiner* — Emmanuel E Duke
(74) *Attorney, Agent, or Firm* — Laurence A. Greenberg; Werner H. Stemer; Ralph E. Locher

(57) ABSTRACT

A food-receiving container for a household refrigeration appliance includes a shell for receiving food and a ventilation device for carrying out an air exchange between the surroundings and the interior of the food-receiving container. The shell has a front panel on which a handle is disposed. The handle is disposed in an upper region of the front panel, when viewed in the vertical direction of the food-receiving container. The ventilation device is disposed on the handle. A household refrigeration appliance having the food-receiving container is also provided.

19 Claims, 6 Drawing Sheets

FOOD-RECEIVING CONTAINER HAVING A VENTILATION DEVICE ON A HANDLE OF A FRONT PANEL, AND HOUSEHOLD REFRIGERATION APPLIANCE

CROSS-REFERENCE TO RELATED APPLICATION

This application claims the priority, under 35 U.S.C. § 119, of German Patent Application DE 10 2020 209 319.9, filed Jul. 23, 2020; the prior application is herewith incorporated by reference in its entirety.

BACKGROUND OF THE INVENTION

Field of the Invention

One aspect of the invention relates to a food-receiving container for a household refrigeration appliance. The food-receiving container has a shell for receiving food. The food-receiving container also has a ventilation device for carrying out an air exchange between the surroundings and the interior of the food-receiving container. A further aspect of the invention relates to a household refrigeration appliance having such a food-receiving container.

Food-receiving containers for household refrigeration appliances are known in many different forms. Those food-receiving containers are generally able to be introduced into a receiving space for food of the household refrigeration appliance. That receiving space is defined by walls of an inner container of the household refrigeration appliance. The receiving space may be a refrigerator compartment or a freezer compartment.

Such a food-receiving container may also be, in particular, a keep-fresh system. To that end, the food-receiving container generally has a shell and a lid. The stored goods introduced therein may thus be individually stored in the keep-fresh system, partially independently of the remaining receiving space. To that end, it is possible to set customized ventilation. To that end, such food-receiving containers have ventilation devices. Such embodiments are disclosed, for example, in European Patent Application EP 2923165 A1, International Publication WO 2014/079781 A1 corresponding to U.S. Pat. No. 9,453,672, and International Publication WO 2014/090644 A1. In those embodiments of the food-receiving container, the ventilation devices are functional devices. In order to actuate those devices, they generally have an actuating part.

In known embodiments of food-receiving containers it is also provided that such a ventilation device is disposed in a lid which is configured and disposed separately from the shell. That results in restricted movement or potentially tight conditions for the operation of the ventilation device.

BRIEF SUMMARY OF THE INVENTION

It is accordingly an object of the invention to provide a food-receiving container having a ventilation device on a handle of a front panel, and a household refrigeration appliance, which overcome the hereinafore-mentioned disadvantages of the heretofore-known containers and appliances of this general type and in which the ventilation device in the food-receiving container is improved.

With the foregoing and other objects in view there is provided, in accordance with the invention, a food-receiving container for a household refrigeration appliance. The food-receiving container has a shell for receiving the food. The food-receiving container also has a ventilation device. An air exchange between the surroundings and the interior of the food-receiving container may be carried out thereby. When viewed in the depth direction of the food-receiving container, the shell has a panel disposed at the front, i.e. a front panel. A handle is disposed on this front panel. When viewed in the vertical direction of the food-receiving container, the handle is disposed in an upper region of the front panel. The ventilation device is disposed on the handle. Through the use of such an embodiment it is achieved that a ventilation device is disposed directly on the shell itself. The ventilation device is also positioned on a specific component, namely the front panel of the shell. As a result, on the one hand, the ventilation device is able to be easily accessed and actuated by a user. As a result, it is possible to control the ventilation through the front panel. On the other hand, the visibility is also improved thereby. Specifically, the positioning in this upper region of the front panel permits a particularly user-friendly operating concept. Since in this context corresponding free space and/or room is generally provided downwardly, therefore, the accessibility for the hand of a user is also improved and simplified. Specifically, the concept of positioning the ventilation device on the handle itself assists this advantageous operating concept. Since a handle is provided in any case for handling the shell, therefore, the actuation of the ventilation device is also intuitive. Since it is common knowledge that the shell is able to be directly gripped by the handle in order to move it, in particular to push the shell in or out in the depth direction, this also persuades the user at the same time that a relevant actuation of the ventilation device may be carried out in a simple manner. Thus an operating concept is also provided in which the corresponding plurality of functions are disposed locally bundled together on this front panel. This includes, on the one hand, gripping the handle in order to displace the food-receiving container, in particular the shell, and, on the other hand, also in order to be able to actuate the ventilation device. In particular, the ventilation device is disposed entirely on the front panel.

In particular, the handle is disposed in an upper vertical third of the front panel. In one exemplary embodiment, the handle is disposed directly at the upper end and thus is positioned at a maximum distance upwardly. The aforementioned advantages are specifically achieved thereby.

In one exemplary embodiment the handle has a handle recess which may be gripped from below. As a result, a particularly simple handling and gripping concept is achieved. In this context the handle recess is constructed in such a way that it is open downwardly in some regions. A user is thus able to grip the handle recess from below with the fingers. The user thus grips behind a front-side handle recess wall which defines the handle recess. At least sub-components of the ventilation device are disposed in this handle recess. Thus a compact construction of the front panel is possible. The specific embodiment of the handle, namely with a handle recess, thus also affords constructional space so that this ventilation device is able to be received. In addition to a space-saving concept, a protected positioning of the ventilation device is also facilitated thereby. It is thus possible to avoid the situation where the ventilation device is knocked or damaged when the shell is pushed in and pulled out of the receiving space of the household refrigeration appliance.

In one exemplary embodiment, the sub-components of the ventilation device are received entirely in the handle recess. As a result, the sub-components are disposed so as to be particularly protected and installed in a compact manner. In particular, therefore, it may be provided that when viewing the shell from the front side, these sub-components are disposed so as to be entirely concealed in the handle recess. Moreover, a tidy and visually uninterrupted appearance of the food-receiving container is afforded thereby.

In one exemplary embodiment, the ventilation device has a ventilation slider. In this context the ventilation slider represents a sub-component of the ventilation device. This ventilation slider is disposed, in particular, in the handle recess. The ventilation slider is displaceably mounted in this handle recess for opening and closing the ventilation device. In particular, this displacement movement is a linear displacement movement. This displacement movement is oriented, in particular, in the width direction of the food-receiving container. Through the use of such an embodiment, the ventilation slider may be positioned in the handle recess, resulting in an advantageous retention and fastening. In particular, therefore, it is also possible to achieve an accurate relative movement of the ventilation slider relative to the handle recess. In particular, therefore, a very accurate concept is achieved for opening and closing the ventilation device. The ventilation slider, in particular, is a separate one-piece component.

In one exemplary embodiment, the shell itself, in particular a shell wall, has at least one ventilation opening of the ventilation device. The ventilation opening is thus configured in one piece with and/or integrated in a shell wall. The ventilation device preferably has a ventilation slider which is configured for opening and closing the ventilation device, wherein the ventilation opening in the shell wall may be uncovered and covered depending on the position of the ventilation slider. A very compact system is also provided thereby in order to be able to achieve, in particular, a ventilation through this ventilation opening of the handle recess. Due to the handle recess and the shape thereof, therefore, it is also possible to generate a well-directed airflow into the handle recess or out of the handle recess, in particular when the ventilation device is open and this ventilation opening of the shell is uncovered.

In one exemplary embodiment, the ventilation opening of the shell wall is formed in a rear side which defines the handle recess. When viewed in the depth direction of the food-receiving container, this rear side is, in particular, a rear handle recess wall. This rear handle recess wall, in particular, is also a shell wall which directly defines the interior of the shell. Thus it is possible to form very short paths for the guidance of the air exchange.

In one exemplary embodiment, the ventilation slider itself has at least one ventilation opening. This at least one ventilation opening is thus configured in one piece and/or integrated in this ventilation slider. This ventilation opening of the ventilation slider is disposed in the open position of the ventilation device so as to overlap at least partially with at least one ventilation opening which is formed in the shell wall. In this regard, in the closed state of the ventilation device, there is no overlap between these at least two ventilation openings.

In one exemplary embodiment, the ventilation slider is configured as an elongated rail-shaped component. The ventilation slider extends over at least 50 percent, in particular at least 60 percent, in particular at least 70 percent, in particular at least 80 percent of the extent of the handle recess measured in the width direction. The handle recess preferably extends over at least 50 percent, in particular at least 60 percent, in particular at least 70 percent, in particular at least 80 percent, in particular at least 90 percent of the width of the front panel. In particular, the width of the shell is also predetermined by the width of the front panel.

In one exemplary embodiment, the shell may have a width which is greater than 30 cm, in particular greater than or equal to 40 cm. A depth of the shell measured in the depth direction is, in particular, greater than 30 cm.

In one exemplary embodiment, the ventilation slider is approximately U-shaped in cross section. This cross section is viewed perpendicular to a longitudinal axis of the ventilation slider. In this exemplary embodiment, therefore, the ventilation slider may also be formed in the manner of a groove. In particular, relative to its groove-shaped and/or its U-shaped embodiment, the ventilation slider is oriented in such a way that the opening of this U-shape is oriented downwardly. In particular, a mechanically stable component is provided thereby. Through the use of this shape, it may also be disposed in an improved manner in the handle recess. Thus a mechanically stable positioning is provided, with at the same time the possibility for accurate displacement. In one exemplary embodiment, the shape of the ventilation slider is adapted, in particular, to the shape of the handle recess and/or to the shape of the walls defining the handle recess. In this regard, a form-locking positioning of the ventilation slider in the handle recess and thus on the walls defining the handle recess may also be provided at least in some regions. In a further exemplary embodiment, the ventilation slider may also be approximately L-shaped in cross section.

A secure retention and a particularly linear displacement movement are permitted by the aforementioned shapes.

The handle recess is defined, in particular, by a front-side handle recess wall, a rear-side handle recess wall and an upper handle recess wall and/or top wall. In particular, the ventilation slider has a front wall, a rear wall and a top wall.

In particular, at least one ventilation opening of the ventilation slider is formed in the rear wall. In the mounted state, this rear wall bears against the inner face of the rear handle recess wall at least in some regions. A top wall of the ventilation slider bears, in particular, against the inner face of an upper handle recess wall. A front wall of the ventilation slider bears, in particular, against an inner face of the front-side handle recess wall.

In one exemplary embodiment, it is provided that the ventilation slider has a handle and/or a handle part. In particular, this handle part protrudes from the handle recess. Thus the handle part is oriented, in particular, so as to be freely protruding. Thus the handle part is positioned so as to be exposed so that it is able to be gripped by a user in a simple manner. A particularly user-friendly operating concept for displacing the ventilation slider is permitted thereby. The handle part may be a downwardly protruding plate-shaped part. The handle part may be configured to be slightly curved. It is also possible that a handle part is configured to be approximately U-shaped in cross section. Thus, for example, the handle part may be configured as an encompassing part. In particular, the handle part may be disposed in such a way that it encompasses a front-side handle recess wall on the front side and rear side and from below.

In one exemplary embodiment, it is provided that the ventilation slider is mounted directly on the walls defining the handle recess. The mounting may be releasable in a non-destructive manner. This may be provided, for example, with at least one snap-in device. In this exemplary embodiment, the ventilation device thus has the ventilation slider which receives the at least one ventilation opening in the shell and the handle part. Further components are thus not provided.

A clamped connection may also be provided in addition to the at least one snap-in connection or alternatively thereto. Then the ventilation slider is held in a clamped manner in the handle recess.

In one exemplary embodiment, it is provided that the ventilation device has, in particular, a rail-shaped carrier part which is separate from the ventilation slider and from the shell. This carrier part is disposed, in particular, in the handle recess. The carrier part is disposed, in particular, directly on the shell. In particular, the carrier part is positioned fixedly on the shell. In particular, a releasable connection of the carrier part on the shell is provided in a non-destructive manner. For example, in this context a snap-in connection and/or a clamped connection may be provided. When viewed in the width direction in which the carrier part extends with its longitudinal axis, it is possible in this context that snap-in elements are provided on opposing ends. These snap-in elements are able to be snapped into snap-in receivers which are provided in the walls of the shell. These walls define the handle recess with the opposing end sides in the width direction. In a further exemplary embodiment, it may be provided that the carrier part is held additionally or alternatively thereto by a clamped connection in the handle recess. In particular, the carrier part is thus anchored to the handle recess walls. It is also possible that positioning hooks are provided. These positioning hooks may be disposed on the shell. In particular, the positioning hooks may be integrally formed in one piece on components of the shell separate from the front panel. This is advantageous, in particular, when the front panel is a separate component and in this regard is separate from a base body of the shell. The base body may be configured in one piece. In an exemplary embodiment, the base body may have the bottom wall of the shell, two opposing vertical side walls of the shell and a vertical rear wall of the shell. These hooks may thus be disposed on a front-side upper edge of the vertical side walls of the base body. When assembling the front panel to the base body, these hooks are able to engage in hook receivers in the front panel. They may be positioned in such a way that they support the carrier part, which is already disposed in the handle recess, from below and/or push the carrier part upwardly. As a result, the carrier part is pushed upwardly by the hooks against the upper handle recess wall.

In one exemplary embodiment, the ventilation slider is movably disposed on the carrier part. In particular, a direct configuration of the ventilation slider on the carrier part is provided in this case. In this context, a guide device may be provided. For example, in this case it is possible to provide a guide opening in which an engagement part and/or an engagement element engages. The guide device is formed by this mechanical coupling. In the mounted state on the carrier part, the ventilation slider may also be displaced thereby relative to the carrier part. In particular, a linear displacement movement is provided in this case. In particular, this linear displacement movement is oriented in the width direction of the food-receiving container.

A plurality of such guide devices may also be provided. These guide devices may be provided as retaining and guiding devices. Both the guiding and the retaining of the ventilation slider on the carrier part is possible thereby. Corresponding snap-in guide devices may be provided in this case. This is possible on a rear-side carrier part wall and a rear-side wall of the ventilation slider. Additionally or alternatively thereto, a corresponding connection may be provided on a front-side carrier part wall and a front-side wall of the ventilation slider.

In one exemplary embodiment, when viewed in cross section, the carrier part is configured to be approximately U-shaped. The carrier part, in particular, is an elongated, in particular rectilinear, rail. In its embodiment as a U-shape, the carrier part may also be configured in the manner of a groove in terms of the shape thereof. In one exemplary embodiment the carrier part extends over at least 50 percent, in particular at least 60 percent, in particular at least 70 percent, in particular at least 80 percent, in particular at least 90 percent of the width of the handle recess.

In one exemplary embodiment, the carrier part is directly disposed on walls which define the handle recess. The configuration is fixed. A non-destructive, releasable connection may be provided. In one exemplary embodiment, as has been already set forth above, the ventilation slider is displaceably mounted directly on the carrier part. The ventilation slider is thus releasably mounted therein in a non-destructive manner.

Advantageous options have already been cited for fastening the carrier part to the handle recess walls.

In one exemplary embodiment, it is provided that the food-receiving container has a lid. This lid is a separate component from the shell. The lid may be configured and disposed so as to be directly positioned onto the shell from above. The lid may be configured merely as a lid closing the shell. However, the lid may additionally be configured as a shelf or as a partition. In such an exemplary embodiment, therefore, the lid is disposed so as to be slightly spaced apart from the shell. The lid is thus disposed on the inner faces of an inner container of the household refrigeration appliance. The inner container is a separate component from the food-receiving container. The inner container is configured, in particular, in a receiving space for food. This receiving space may be a refrigerator compartment or a freezer compartment. The food-receiving container is able to be received in the inner container in a movable manner, in particular in a displaceable manner in the depth direction.

In one exemplary embodiment, the ventilation device has a display unit for displaying the ventilation operating states of the ventilation device. In one exemplary embodiment, this display unit is disposed in the handle of the shell. In one exemplary embodiment, a displayed ventilation operating state may be observed on a top wall and/or an upper handle recess wall of the handle. This means that this displayed ventilation operating state is visible and observable from above. It may be provided that this top wall and/or the upper handle recess wall has at least two viewing windows. These viewing windows are, in particular, continuous holes. In one exemplary embodiment, it may be provided that symbols which characterize the different ventilation operating states are disposed on a top wall of the ventilation slider and/or on a top wall of the carrier part. In particular, when the ventilation device has only the ventilation slider and no carrier part, these symbols may be provided on the top wall of the ventilation slider. Depending on the displacement position, therefore, the respective symbols may be seen and identified through at least one of these viewing windows. If the ventilation device has the above-mentioned carrier part, it may be provided that this carrier part also has viewing windows. These viewing windows may be disposed in a congruent manner with the viewing windows in the upper handle recess wall. In this case, therefore, depending on the displacement position of the ventilation slider, the symbol may be observed through the viewing window on the upper handle recess wall and the viewing window of the carrier part. In particular, the viewing windows are provided in the case of an opaque embodiment of the upper handle recess wall.

It is also possible that this upper handle recess wall is transparent at least in some regions. The upper handle recess wall may then be configured without such a continuous viewing window. Then the respective symbol which characterizes the ventilation state is visible through the transparent region of this upper handle recess wall.

In principle, it is possible that the walls which define the handle recess are transparent at least in some regions, in particular entirely. It is also possible that at least one of these walls is opaque and thus non-transparent. Thus many different variants of food-receiving containers are also possible in this regard.

In one exemplary embodiment, the front panel is movably disposed on a base body of the shell on the front side. The exemplary embodiment of a base body has already been described above.

As an alternative to the aforementioned exemplary embodiment in which the display unit and/or the indicator for displaying an ventilation operating state is configured in a top wall of the handle of the shell, and/or may be seen from there, additionally or alternatively thereto it may also be provided that this display of the ventilation operating state is disposed on a front handle recess wall. The ability to observe the ventilation operating state is thus permitted through this front-side handle recess wall of the handle of the shell.

The positions and orientations provided when the container and/or the appliance is used as intended and disposed as intended are specified by the terms "top," "bottom," "front," "rear," "horizontal," "vertical," "depth direction," "width direction," "vertical direction".

Further features of the invention are disclosed in the claims, the figures and the description of the figures. The features and combinations of features cited above in the description, as well as the features and combinations of features cited hereinafter in the description of the figures and/or shown individually in the figures, are able to be used not only in the respectively specified combination but also in other combinations or alone, without departing from the scope of the invention. Thus embodiments which are not explicitly shown and described in the figures, but which are revealed and are able to be generated by separate combinations of features from the described embodiments, are also to be regarded as encompassed and disclosed by the invention. The embodiments and combinations of features which, therefore, do not have all of the features of an originally formulated independent claim are to be regarded as disclosed.

Although the invention is illustrated and described herein as embodied in a food-receiving container having a ventilation device on a handle of a front panel, and a household refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
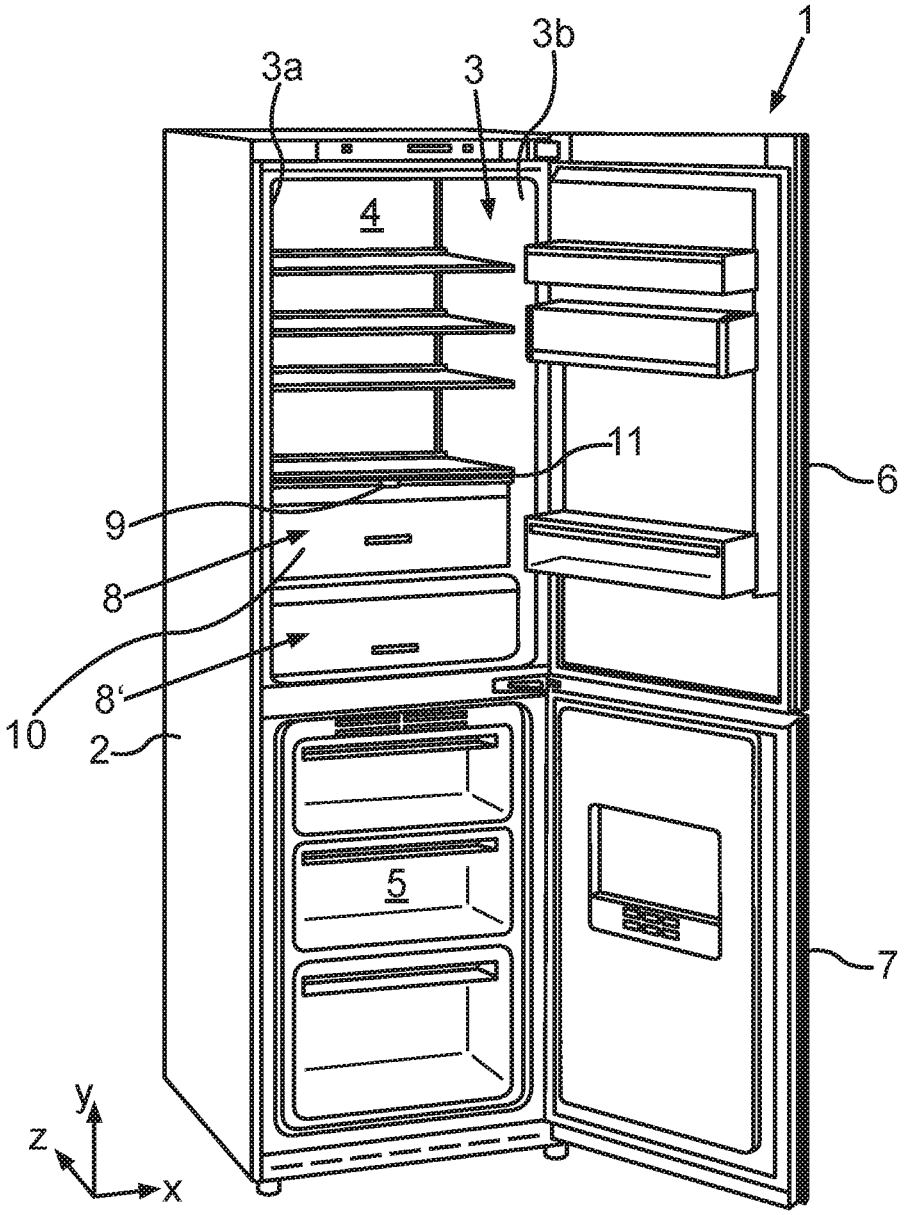
FIG. 1 is a diagrammatic, perspective view of an exemplary embodiment of a household refrigeration appliance according to the invention.

Referring now in detail to the figures of the drawings, in which the same or functionally the same elements are provided with the same reference characters, and first, particularly, to FIG. 1 thereof, there is seen an exemplary view of a household refrigeration appliance 1 which is configured as a combined refrigerator-freezer. The household refrigeration appliance 1 has a body or carcass 2 with an inner container 3. The inner container 3 has, amongst other things, two opposing vertical side walls 3*a* and 3*b*. The inner container 3 defines with its walls a first interior or receiving space 4 which is a refrigerator compartment and a second interior or receiving space 5 which is separate therefrom and which is disposed by way of example below the refrigerator compartment and which is a freezer compartment. The receiving space 4 generally serves for the frost-free refrigeration of refrigerated goods, preferably at temperatures of between +4° and +8° C. The receiving space 4, however, may also be configured as a zero-degrees drawer, in particular for keeping fruit or vegetables fresh. The receiving space 4 is accessible when a door 6, which closes the receiving space 4 on the front side, is open.

The further receiving space 5 generally serves for deep-freezing frozen goods, for example at −18° C. The receiving space 5 is accessible when a freezer compartment door 7 is open.

A refrigerated goods container and/or keep-fresh container is mounted in the above receiving space 4 in a manner in which it is able to be pulled out. The keep-fresh container constitutes a food-receiving container 8. The food-receiving container 8 has a drawer and/or shell 10. In one exemplary embodiment, the food-receiving container 8 also has a lid 9. This lid is separate from the shell 10. The lid 9 may be provided only for closing the shell 10 from above. The lid may then be positioned directly on the shell 10. In one exemplary embodiment it may also be provided that the lid 9 is configured at the same time as a shelf or partition. The lid is then, in particular, directly mounted on the side walls 3*a* and 3*b*. In one exemplary embodiment, therefore, the lid does not directly bear against the shell 10 but is disposed, in particular, so as to be offset upwardly at a minimum distance.

It may also be provided, as shown, that a separate cover 11, for example in the form of a partition, for example a glass shelf, is disposed in addition to the lid 9. This cover is disposed directly above the lid 9 and slightly spaced apart from the lid 9.

A further or different food-receiving container 8' may also be provided.

The food-receiving container 8 is separated at least by the cover 11 from the residual partial volume of the receiving space 4 which remains.

The food-receiving container 8 may be removed from the receiving space 4 in a non-destructive manner. Even in the state inserted into the receiving space 4 it is provided that the shell 10 may be pushed back and forth in the depth direction and thus in the z-direction, in the state still mounted in the receiving space 4, in order to be able to reach into the interior of the shell 10. The same may also be provided in the food-receiving container 8'. This food-receiving container may also be configured with a shell and, in particular, also with a lid.

Figure 2:
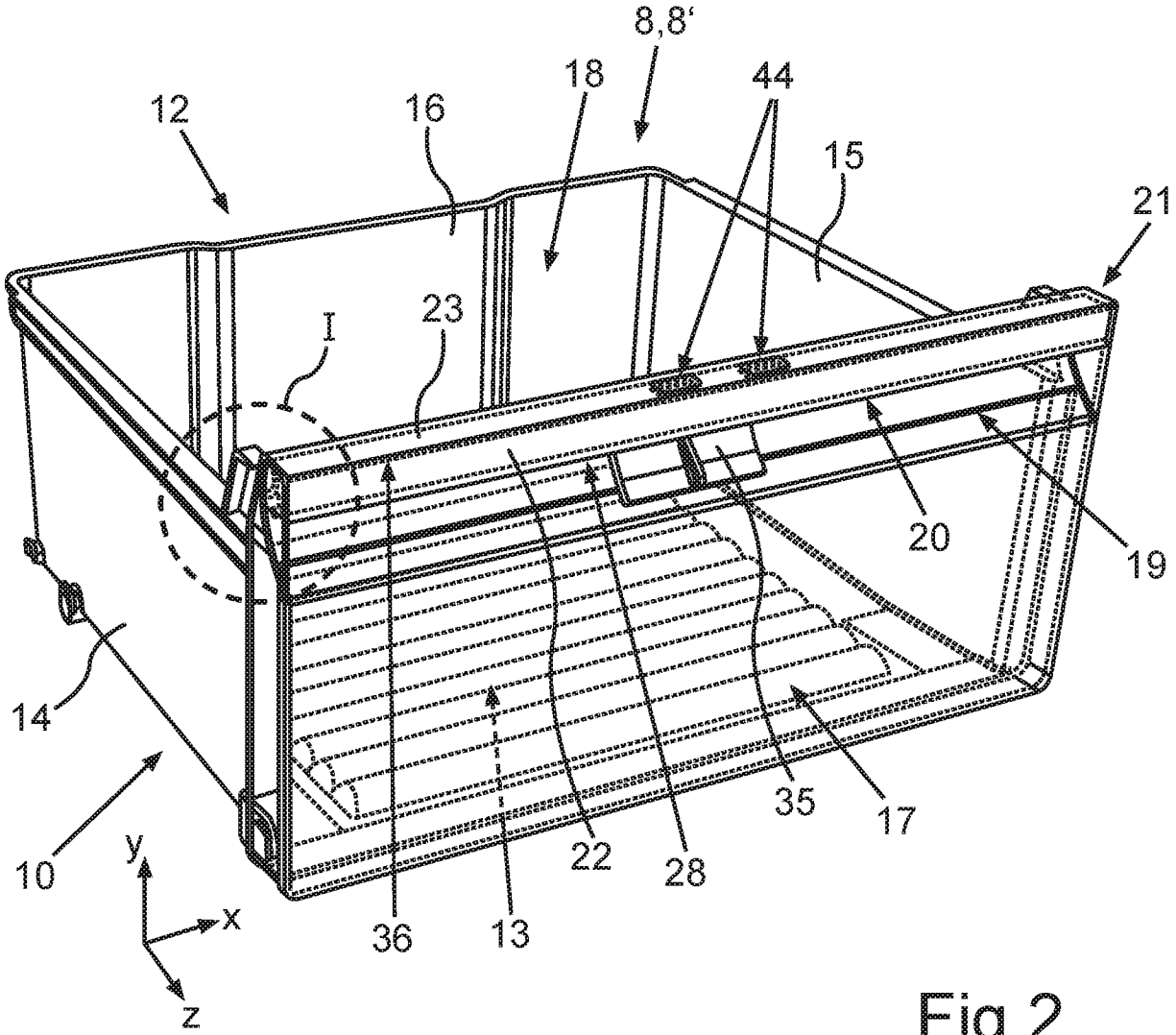
FIG. 2 is a perspective view of an exemplary embodiment of a food-receiving container according to the invention.

In FIG. 2 an exemplary embodiment of a food-receiving container 8, 8' is shown in a perspective view. The shell 10 is shown herein. This shell has a base body 12. The base body 12 is configured in one piece in this case. The base body has a bottom wall 13 of the shell 10, vertical opposing side walls 14 and 15 as well as a rear wall 16.

The shell 10 also has a front panel 17. The front panel 17 in the exemplary embodiment is a separate component from the base body 12. The front panel constitutes a front wall of the shell 10. The front panel is releasably disposed on the base body 12 in a non-destructive manner. The front wall and/or the front panel 17 directly defines on the front side a storage space 18 of the shell 10.

The front panel 17 is configured in the manner of a plate. The front panel 17 has a handle 19. The handle 19 is configured in one piece in the front panel 17. In the exemplary embodiment, the handle 19 extends substantially over the entire width of the front panel 17. In the exemplary embodiment, the front panel 17 extends substantially over the entire width of the shell 10. The handle 19 has a handle recess 20. The handle recess 20 is open downwardly. As a result, the handle may be gripped from below, when approached from the front. When viewed in the vertical direction (y-direction) the handle 19 is provided in an upper region of the front panel 17. The handle is provided, in particular, in an upper third of the height of the front panel 17. In particular, the handle is disposed on an upper edge 21 of the front panel 17. The handle thus constitutes an upper terminal portion of the front panel 17.

Figure 3:
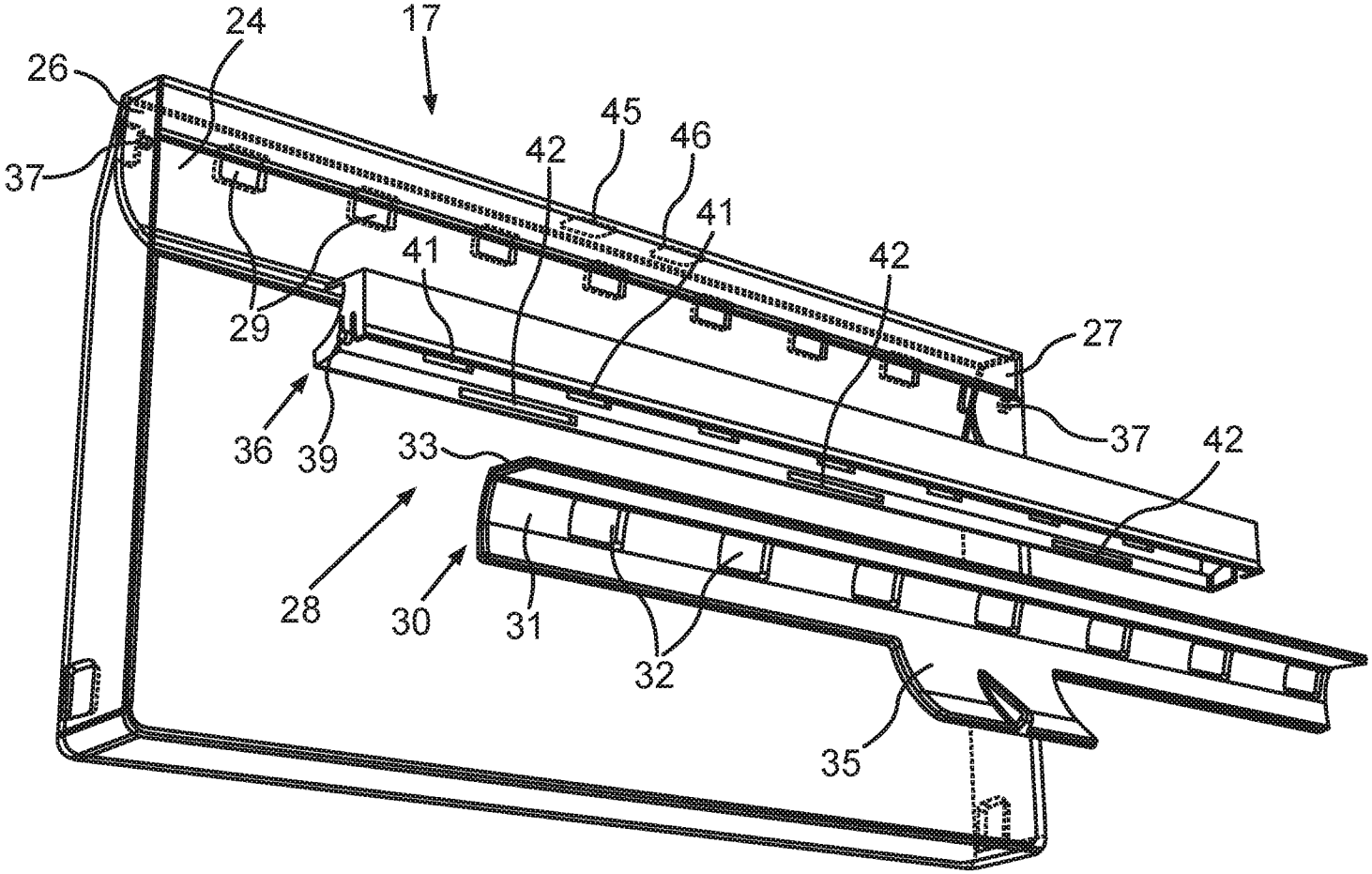
FIG. 3 is an exploded, perspective view of an exemplary embodiment of a ventilation device which is disposed on a front panel of the food-receiving container according to FIG. 2.

When viewed in the depth direction, the handle recess 20 is defined by a front-side handle recess wall 22 and upwardly by an upper handle recess wall 23 and rearwardly by a rear handle recess wall 24 (FIG. 3).

Moreover, when viewed in the width direction, further opposing defining walls are configured as handle recess walls which are represented by handle recess walls 26 and 27 (FIG. 3).

The food-receiving container 8, 8' also has a ventilation, air-conditioning or climatizing device 28. Through the use of this ventilation device 28, an air exchange may be carried out between the surroundings and the interior of the shell 10 which is formed by the storage space 18, in particular through the front panel 17.

In the exemplary embodiment, the ventilation device 28 is disposed on the shell 10. The ventilation device 28 is disposed entirely on the front panel 17.

Even if the lid 9 is a component of the food-receiving container 8, 8', in one exemplary embodiment the ventilation device 28 is disposed entirely in the front panel 17.

As may be identified, at least sub-components of the ventilation device 28 are disposed on the handle 19. In particular, in this regard sub-components of the ventilation device 28 are disposed in the handle recess 20, in particular received entirely therein.

In the illustrated exemplary embodiment, the front panel 17 is shown in an exploded view in FIG. 3. In this exemplary embodiment the ventilation device 28 has at least one ventilation opening, in particular a plurality of ventilation openings 29. For the sake of clarity, only some of these ventilation openings 29 are provided with the corresponding reference characters in FIG. 3. The ventilation openings 29 are directly integrated in the front panel 17 and/or configured in one piece therewith. The ventilation openings are positioned, in particular, entirely within the handle recess 20. In particular, in this regard the ventilation openings are formed in the rearward handle recess wall 24. The ventilation openings are configured in rows relative to one another in the width direction and spaced apart from one another.

In the exemplary embodiment, the ventilation device 28 also has a ventilation slider 30. The ventilation slider 30 constitutes a separate component from the front panel 17. The ventilation slider is constructed in the manner of a rail and/or bar. In the exemplary embodiment shown herein, the ventilation slider 30 has a rear wall 31. In particular, a plurality of ventilation openings 32 are formed in this rear wall 31. For the sake of clarity, only some of the ventilation openings are provided with the corresponding reference character. Moreover, in the exemplary embodiment the ventilation slider 30 has a top wall and/or an upper wall 33.

In a further exemplary embodiment, in addition to the rear wall 31 and the upper wall 33, a front wall 34 viewed in the depth direction (FIG. 6) may also be provided.

In FIG. 3 the one-piece ventilation slider 30 is additionally provided with a handle 35. This handle is formed in this case in one piece with the rear wall 31. The handle extends downwardly and to the front. The handle protrudes according to the view in FIG. 2 downwardly out of the handle recess 20. The handle is disposed so as to be freely protruding relative thereto.

The ventilation slider 30 is displaceably disposed in the handle recess 20. In particular, a linear displacement movement is possible in this case, in particular in the width direction. To this end, it is provided that the ventilation device 28 is open when the ventilation openings 32 are disposed so as to be at least partially overlapping with the ventilation openings 29. If the ventilation slider 30 is displaced in such a way that there is no overlap between the ventilation openings 32 and the ventilation openings 29, the ventilation device 28 is closed.

In one exemplary embodiment, it may be provided that the ventilation device 28 has only the ventilation slider 30, in particular with the handle 35 and the ventilation openings 29, 32.

In a further exemplary embodiment, it may be provided that the ventilation device 28 additionally has a carrier part 36 separate therefrom. This is shown in FIG. 3 and in FIG. 2. The carrier part 36 is also separate from the front panel 17. The carrier part 36 is an elongated, in particular rectilinear, rail. The carrier part extends substantially over the entire width of the handle recess 20. In the mounted state the carrier part 36 is received in the handle recess 20. In particular, the carrier part is received entirely therein. The carrier part 36 is disposed so as to bear directly against the handle recess walls 22, 23 and 24. The carrier part may be correspondingly fastened by a snap-in connection and/or by a clamped connection to at least one of these handle recess walls 22 and/or 23 and/or 24. Additionally or alternatively thereto, a mechanical coupling may be provided on the further handle recess walls 26, 27. In the exemplary embodiment, these lateral handle recess walls 26 and 27 have a snap-in receiver 37 and 38. Snap-in elements 39, 40 (FIG. 5) which are integrally formed in one piece on the carrier part 36 are snapped therein.

Moreover, the carrier part 36 has ventilation openings 41, wherein in this case only some of the ventilation openings are provided with the corresponding reference character. In the mounted state of the carrier part 36 the ventilation openings 41 are disposed, in particular, so as to be congruent with the ventilation openings 29. In the mounted state, the carrier part 36 is disposed fixedly on the front panel 17 in the handle recess 20. The ventilation slider 30 is disposed on this carrier part 36 so as to be relatively displaceable thereto, in particular is mounted directly thereon.

Figure 5:
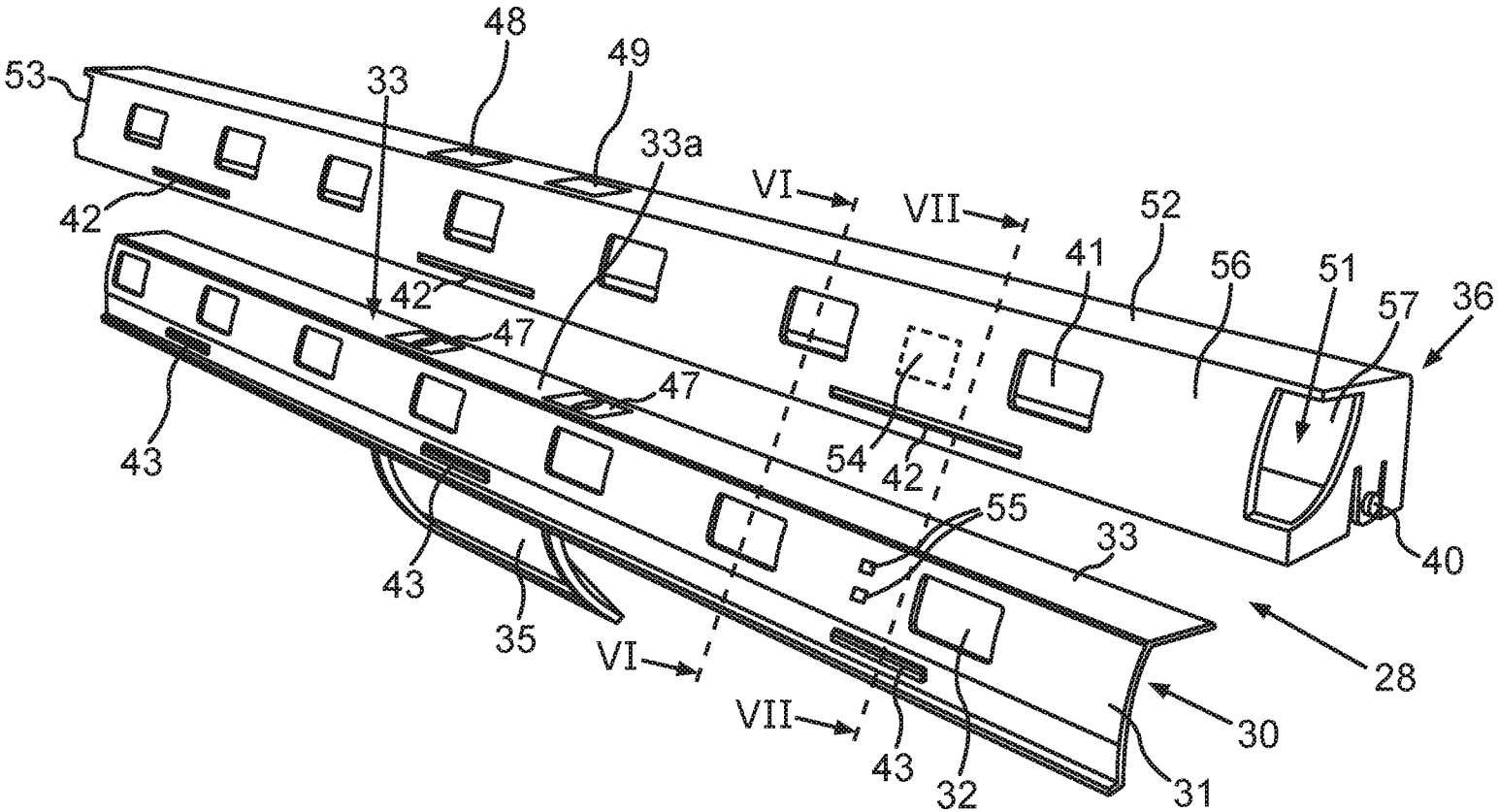
FIG. 5 is an exploded, perspective view of an exemplary embodiment of sub-components of a ventilation device of the food-receiving container.

It may be provided that the ventilation slider 30 is directly disposed on the carrier part 36 by a snap-in connection and/or by a clamped connection. In particular, it is provided that a guide device is provided ed by which the ventilation slider 30 is displaceably mounted on the carrier part 36. In particular, a retention is also possible thereby. Relative to the guide device the carrier part 36 has, for example, a guide receiver 42. Engagement elements 43 engage in this guide receiver (FIG. 5). In the exemplary embodiment these engagement elements 43 are rectilinear projections. The engagement elements are integrally formed in one piece on the rear wall 31. When viewed in the width direction, these engagement elements 43 are shorter than the slotted guide receivers 42. As a result, a relative displacement of the ventilation slider 30 relative to the carrier part 36 may take place on this carrier part 36.

This guide device may also serve as a retaining device, in particular when the ventilation slider 30 is held by a clamped retention on the carrier part 36.

In the exemplary embodiment of the ventilation slider 30 shown in FIG. 3, this ventilation slider is L-shaped in cross section (perpendicular to its longitudinal axis oriented in the width direction). As already set forth above, an embodiment of the ventilation slider 30 may also be provided which is U-shaped in this cross section.

In an exemplary embodiment, it is provided that the shell 10, in particular the front panel 17, has a display unit 44 (FIG. 2). The display unit 44 is configured for displaying a ventilation operating state of the ventilation device 28. The display unit 44 may also be denoted as an indicator. In the exemplary embodiment, the display unit 44 is disposed in such a way that the display of the ventilation operating state may be seen and observed on the upper handle recess wall 23. It may be provided that two viewing windows 45 and 46 are provided in this upper handle recess wall 23 as shown in FIG. 3.

These viewing windows 45 and 46 are, in particular, continuous holes. It may be provided that symbols 47 are displayed on an upper face 33*a* (FIG. 5) of the upper wall 33 of the ventilation slider 30. These symbols 47 may be printed. Different ventilation operating states may be symbolized by these symbols 47. Depending on the displacement position of the ventilation slider 30 relative to these viewing windows 45 and 46, in particular, one of these symbols 47 may thus be observed through one of the viewing windows 45 or 46.

As may also be identified in FIG. 5, the carrier part 36 may also have such viewing windows 48 and 49. In the mounted state of the carrier part 36, these viewing windows are disposed so as to be congruent with the viewing windows 45 and 46.

In this embodiment of the display unit 44 at least the upper handle recess wall 23 may be formed so as to be opaque.

If the upper wall 23 is formed so as to be transparent, the viewing windows 45 and 46 do not have to be present. If the carrier part 36 is present, depending on the transparency or opaqueness of the carrier part 36 it may be provided that the viewing windows 48 and 49 are present or not present.

Figure 4:
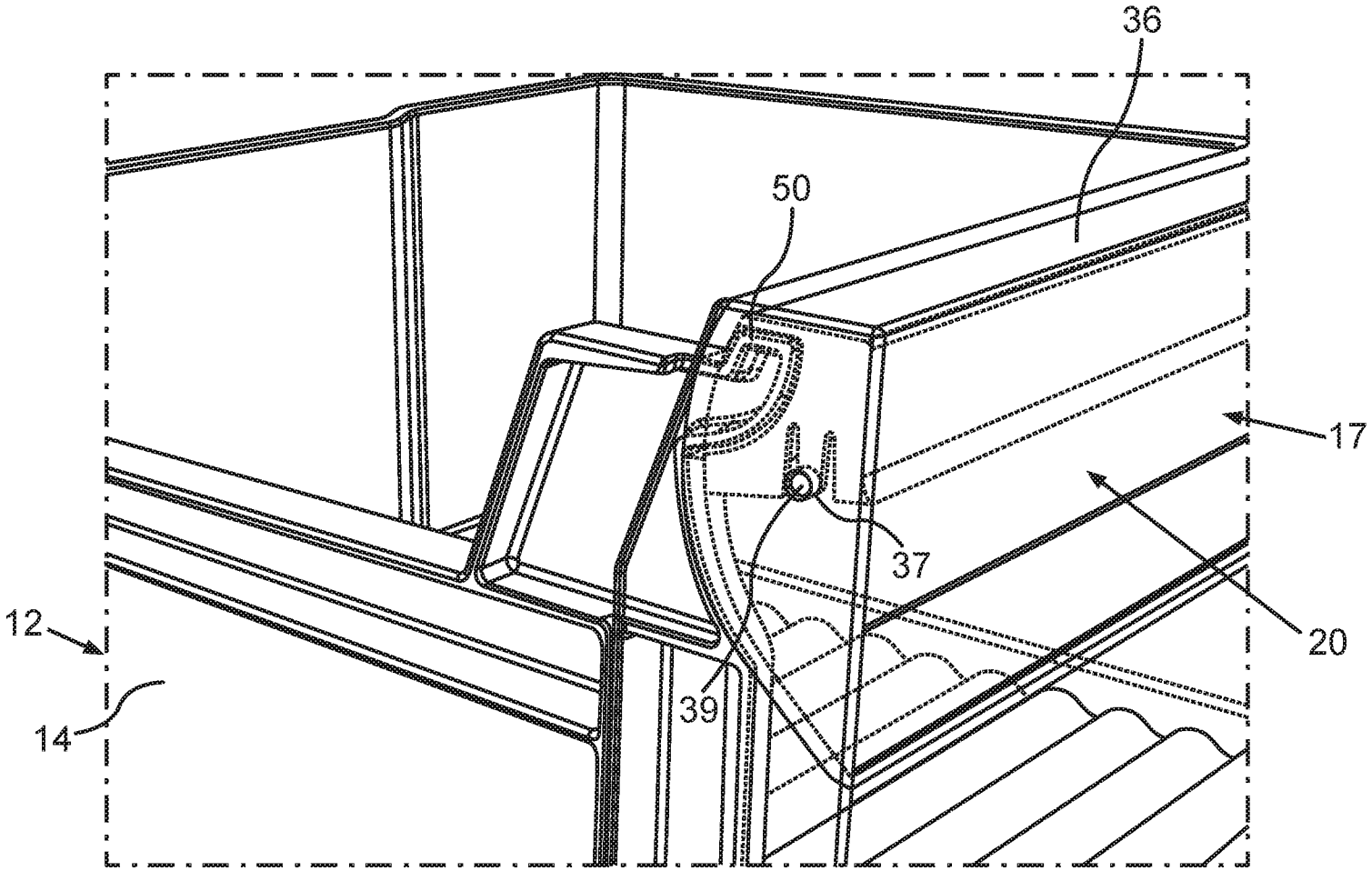
FIG. 4 is a fragmentary, perspective view of a region I in FIG. 2.

In FIG. 4 an enlarged view of the partial region I in FIG. 2 is shown. In this case the already mounted state of the carrier part 36 present in the handle recess 20 may be identified. The snapped-in state between the snap-in element 39 in the snap-in receiver 37 may be identified in this case.

In one exemplary embodiment, it may be provided that the side wall 14 has a hook 50 in an upper front corner region. This is provided, in particular, when the front panel 17 is a separate component from the base body 12. The hooking of the front panel 17 to the base body 12 in the upper region is made possible thereby. In one exemplary embodiment, this hook 50 is also provided at the same time to fix the carrier part 36. To this end, in one exemplary embodiment it is provided that the carrier part 36 has an engagement region 51 (FIG. 5). The hook 50 engages therein and then bears from below against an upper wall 52 of the carrier part 36. As a result, this carrier part 36 is additionally pushed upwardly against the upper handle recess wall 23. In particular, such a further engagement region 53 is also provided on the opposing end, a further hook which is disposed on the upper front region of the side wall 15 engaging therein.

In FIG. 5 an exploded view of the exemplary embodiment is shown, in which the ventilation device 28 has the ventilation slider 30 and the carrier part 36.

In FIG. 5 it is shown in a diagrammatic view that the guide receivers 42 are disposed below the ventilation openings 41. In a further exemplary embodiment, a guide opening 54 of the guide device may be provided additionally or alternatively thereto. This guide opening 54, for example, may not be configured as a slot but as a square or rectangle which is dimensioned differently from a slot relative to the aspect ratios thereof. It may be provided that, when viewed in the vertical direction, this at least one window and/or the guide opening 54 is disposed in the region of the ventilation openings 41 and is disposed between two ventilation openings 41 and in each case is located therebetween. In this exemplary embodiment it may be provided that an engagement element 55 is provided, the engagement element being provided on the ventilation slider 30, in particular on the wall 31. This engagement element may be, for example, a snap-in element. The snap-in element may then be snapped into the guide opening 54 and guided in a linear manner relative thereto in the width direction. This exemplary embodiment may be provided as an alternative to the exemplary embodiment with the guide openings 42 and the engagement elements 43. However, it may also be provided additionally thereto.

In all of the exemplary embodiments it is also possible that such a mechanical coupling in the form of a guide device and/or retaining device is provided on the upper walls 33 and/or 52 and/or the upper handle recess wall 23.

Figure 6:
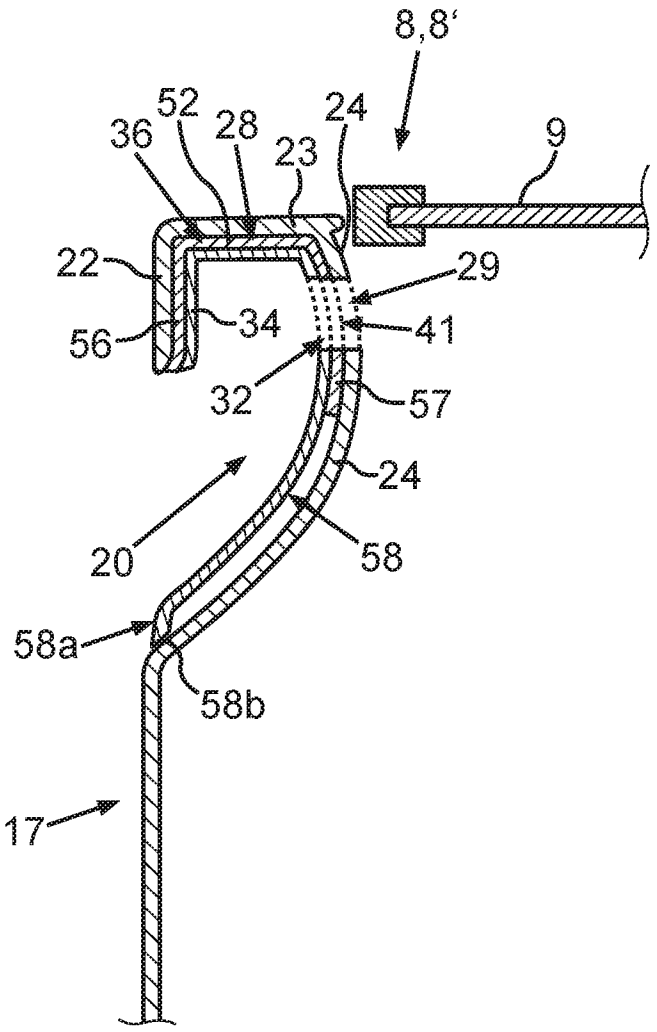
FIG. 6 is a diagrammatic, vertical sectional view through an exemplary embodiment of a food-receiving container with an exemplary embodiment of a ventilation device in a first displaced state of a ventilation slider of the ventilation device.

In FIG. 6 a partial region of the food-receiving container 8, 8' is shown in a diagrammatic vertical sectional view. The ventilation device 28 is implemented in this case with the ventilation slider 30 and the carrier part 36 separately therefrom. In this exemplary embodiment it is provided that the ventilation slider 30 is not L-shaped but U-shaped in cross section. In this case, the sectional view is taken through a corresponding section line VI-VI, as shown in FIG. 5. The ventilation slider 30 is not L-shaped in cross section in this case, as already set forth above, but U-shaped. It may also be identified that the carrier part 36 which is U-shaped in cross section bears directly against the inner faces of the handle recess walls 22, 23 and 24. A form-locking bearing may be provided. Moreover, the ventilation slider 30, shown herein in its approximately U-shaped form, bears directly against the walls 56, 52 and 57 of the carrier part 36.

In FIG. 6 a position of the ventilation slider 30 is shown in which the ventilation device 28 is open.

In one exemplary embodiment it is provided that a rear-side wall 58 of the approximately U-shaped ventilation slider 30 extends downwardly over the rear-side wall 57 of the carrier part 36. The overlap of this rear wall 58 protruding downwardly relative thereto, however, is disposed substantially without contact with the rear-side handle recess wall 24. A direct bearing with a marginal edge 58*b* on the inner face of the rear handle recess wall 24 is provided merely on a lower freely protruding end 58*a*. As a result, a bearing of this wall 58 against the rear handle recess wall 24 over a large surface area is avoided. A simpler displacement of the ventilation slider 30 is thus possible. In particular, the scratching of the inner face of the rear-side handle recess wall 24 is also avoided thereby.

Figure 7:
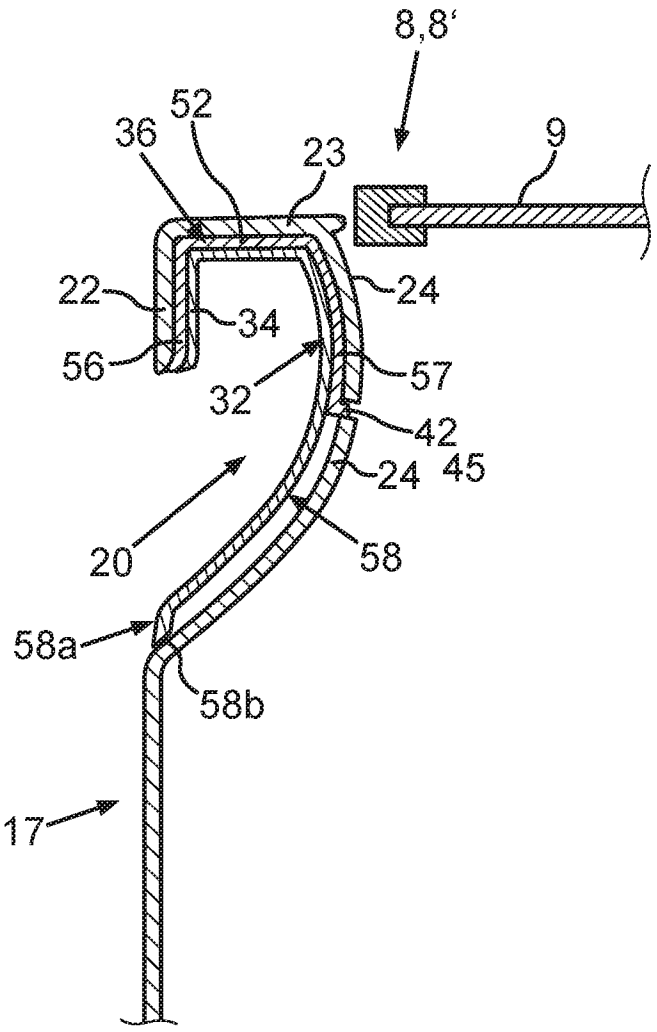
FIG. 7 is a vertical sectional view of a partial region of an exemplary embodiment of a food-receiving container of the exemplary embodiment of FIG. 6, wherein the section plane in FIG. 7 is different from FIG. 6.

In FIG. 7 an embodiment according to FIG. 6 is shown in a vertical sectional view, wherein however a sectional view along the section line VII-VII in FIG. 5 is shown. In this case the engagement of the projection 43 in this guide receiver 42 is shown. By way of example, the L-shape of the ventilation slider 30 is not shown herein, but the approximately U-shaped cross-section of the ventilation slider 30 shown in FIG. 6 is illustrated. Through the use of this U-shape of the carrier part 36 and the approximate U-shape of the ventilation slider 30 it is possible to a certain extent to maintain the position of the ventilation slider 30 on the carrier part 36 by an improved anchoring clamped connection.

The following is a summary list of reference numerals and the corresponding structure used in the above description of the invention.

LIST OF REFERENCE CHARACTERS

1 Household refrigeration appliance
2 Body
3 Inner container
3*a* Vertical side wall
3*b* Vertical side wall
4 Receiving space
5 Receiving space
6 Door
7 Freezer compartment door
8 Food-receiving container
8' Food-receiving container
9 Lid
10 Shell
11 Cover
12 Base body
13 Bottom wall
14 Side wall
15 Side wall
16 Rear wall
17 Front panel
18 Storage space
19 Handle
20 Handle recess
21 Upper edge
22 Front-side handle recess wall
23 Upper handle recess wall
24 Rear handle recess wall
26 Handle recess wall
27 Handle recess wall
28 Ventilation device
29 Ventilation opening
30 Ventilation slider
31 Rear wall
32 Ventilation opening
33 Upper wall
34 Front wall
35 Handle
36 Carrier part
37 Snap-in receiver
38 Snap-in receiver
39 Snap-in element
40 Snap-in element
41 Ventilation opening
42 Guide receiver
43 Engagement element
44 Display unit
45 Viewing window
46 Viewing window
47 Symbol
48 Viewing window
49 Viewing window
50 Hook
51 Engagement region
52 Upper wall
53 Engagement region
54 Guide opening
55 Engagement element
56 Wall
57 Wall
58 Rear wall
58*a* End
58*b* Marginal edge
y Vertical direction

The invention claimed is:

1. A food-receiving container for a household refrigeration appliance, the food-receiving container comprising:
- an interior of the food-receiving container and a vertical direction of the food-receiving container;
- a shell for receiving food, said shell having a front panel with upper region as viewed in the vertical direction of the food-receiving container;
- a handle disposed at said upper region of said front panel; and
- a ventilation device disposed at said handle for carrying out an air exchange between the surroundings and said interior of the food-receiving container.

2. The food-receiving container according to claim 1, wherein said handle has a handle recess configured to be gripped from below, said ventilation device has sub-components, and at least said sub-components of said ventilation device are received partly or entirely in said handle recess.

3. The food-receiving container according to claim 2, wherein said ventilation device has a ventilation slider displaceably mounted in said handle recess for opening and closing said ventilation device.

4. The food-receiving container according to claim 3, wherein said ventilation device has a rail-shaped carrier part being separate from said ventilation slider and from said shell, said carrier part is disposed on said shell, and said ventilation slider is movably disposed on said carrier part.

5. The food-receiving container according to claim 4, wherein:

said handle has walls defining said handle recess;

said carrier part is at least one of U-shaped in cross section or directly fastened to said walls defining said handle recess; and said ventilation slider is directly mounted on said carrier part.

6. The food-receiving container according to claim 4, wherein said ventilation slider has a top wall, said carrier part has a top wall, and symbols characterizing different ventilation operating states are disposed on at least one of said top wall of said ventilation slider or said top wall of said carrier part.

7. The food-receiving container according to claim 2, wherein:

said shell has a shell wall;

said ventilation device has at least one ventilation opening integrally formed in said shell wall; and said ventilation device has a ventilation slider for uncovering and covering said at least one ventilation opening for opening and closing said ventilation device.

8. The food-receiving container according to claim 7, wherein said handle has a rear handle recess wall defining said handle recess, and said ventilation opening is formed in said rear handle recess wall.

9. The food-receiving container according to claim 7, wherein said ventilation slider has at least one ventilation opening configured to at least partially overlap said at least one ventilation opening in said shell wall in an open position of said ventilation device.

10. The food-receiving container according to claim 7, wherein said ventilation slider has an L-shaped or U-shaped cross section.

11. The food-receiving container according to claim 7, wherein said ventilation slider has a further handle.

12. The food-receiving container according to claim 7, wherein said handle has walls defining said handle recess, and at least one snap-in device directly fastens said ventilation slider to said walls defining said handle recess.

13. The food-receiving container according to claim 12, wherein said ventilation slider is displaceably mounted on at least one of said walls by said at least one snap-in device.

14. The food-receiving container according to claim 1, wherein said ventilation device has a display unit for displaying ventilation operating states of said ventilation device, and said display unit is disposed in said handle.

15. The food-receiving container according to claim 14, wherein said handle has an upper handle recess wall on which a displayed ventilation operating state is able to be observed.

16. The food-receiving container according to claim 1, wherein:

said ventilation device has a sub-component;

said shell has a base body with a front side;

said front panel is movably disposed on said front side of said base body; and said base body has at least one hook engaging in said front panel in a basic position of said front panel on said base body for retaining said sub-component of said ventilation device on said front panel.

17. The food-receiving container according to claim 1, which further comprises a lid of the food-receiving container, said lid being separate from said shell and configured to be positioned onto said shell for closing said shell.

18. The food-receiving container according to claim 1, which further comprises symbols characterizing different ventilation operating states of said ventilation device.

19. A household refrigeration appliance, comprising a food-receiving container according to claim 1.

* * * * *